US006053223A

United States Patent [19]

Kilpeläinen et al.

[11] Patent Number: 6,053,223

[45] Date of Patent: Apr. 25, 2000

[54] CHIP OUTLET IN A DISC CHIPPER

[75] Inventors: Reijo Kilpeläinen, Lahti, Finland; Anders Olofsson, Domsjö , Sweden

[73] Assignee: Andritz-Patentverwaltungs-GmbH, Graz, Austria

[21] Appl. No.: 09/260,112

[22] Filed: Mar. 2, 1999

[30] Foreign Application Priority Data

Mar. 3, 1998 [FI] Finland ..... 980477

[51] Int. Cl.[7] ..... B27C 1/00

[52] U.S. Cl. ..... 144/176; 144/162.1; 144/373; 241/92; 241/298

[58] Field of Search ..... 144/162.1, 176, 144/241, 373; 241/92, 292, 292.1, 298, 296

[56] References Cited

U.S. PATENT DOCUMENTS

| | | | |
|---|---|---|---|
| 2,337,407 | 12/1943 | Ottersland | 144/212 |
| 2,712,904 | 7/1955 | Durkee | 241/92 |
| 3,061,207 | 10/1962 | Clark | 241/92 |
| 3,384,311 | 5/1968 | Eklund et al. | 144/176 |
| 3,746,062 | 7/1973 | Nystrom et al. | 144/176 |
| 4,685,497 | 8/1987 | Mierau et al. | 144/176 |
| 4,977,939 | 12/1990 | Depuy et al. | 144/176 |

FOREIGN PATENT DOCUMENTS

| | | |
|---|---|---|
| 1740/67 | 6/1967 | Finland . |

*Primary Examiner*—W. Donald Bray
*Attorney, Agent, or Firm*—Alix, Yale & Ristas, LLP

[57] ABSTRACT

A tool wheel rotatably mounted in a disc chipper. The tool wheel includes a plurality of chip outlets. Each chip outlet comprises an elongated aperture extending through the tool wheel. At least one of the ends of the chip outlet is integrally made in the basic material of the tool wheel in a beveled fashion relative to the center axis of the tool wheel.

11 Claims, 3 Drawing Sheets

CHIP OUTLET IN A DISC CHIPPER

BACKGROUND OF THE INVENTION

The present invention relates to a disc chipper for use in chipping wood for subsequent pulping. More particularly the invention relates to a disc or tool wheel which is mounted for rotation about an axis in the disc chipper.

The disc or tool wheel includes a working face and an opposing discharge face. A plurality of knives or chipper tools are mounted to the working face to create the wood chips. A corresponding plurality of chip outlets extend through the tool wheel to discharge the chips produced in the chipping process. Each chip outlet is an elongated aperture, having a length which is at least equal to that of the tool. The chip outlet defines a longitudinal axis, which is typically arranged in the radial direction or at a slightly offset angle relative to the radial direction.

Generally in tool wheels, the ends and side surfaces of the chip outlets are perpendicular to the face of the disc. The outlet or aperture present in the basic material of a tool wheel may become worn so that it is no longer perpendicular relative to the face of the wheel or disc. This is typically rectified by means of a separate attachment fitted to the end of the chip outlet.

In a prior known arrangement, the perpendicular end of a chip outlet is fitted with an attachment which provides the end of the chip outlet with a beveled guide for securing a greater flow of chips produced in the chipping process through the chip outlet. Such an attachment reduces significantly the exploitable length of a chip outlet and its associated chipping tool. Further, these attachments are difficult and expensive to manufacture and maintain, thus incurring continuously high costs as such attachments must be replaced as a result of wear and tear.

SUMMARY OF THE INVENTION

An object of the invention is to increase the flow of chips through tool wheel chip outlet.

Another object of the invention is to increase the flow of chips through a tool wheel chip outlet while enabling the use of longer chipper tools.

Yet another object of the invention is to increase the flow of chips through a tool wheel chip outlet while reducing the tension level of the tool wheel and increasing its fatigue strength.

The invention comprises a tool wheel including a chip outlet. The chip outlet is an integral, elongated aperture with two spaced ends connected by a straight section. At least one end is inclined at an angle or beveled relative to the axis of rotation of the tool wheel. Preferably the angle of inclination is such that the bevel extends radially outward from the working face to the discharge face. This arrangement enables the use of a longer tool in comparison with a prior art tool wheel of the same size.

In one embodiment of the invention, the arrangement is such that the end of a chip outlet has a beveling of at least 10 degrees relative to the center axis of the tool wheel. This reduces the tension level of the tool wheel and improve its fatigue strength. The reduction of the tension level allows making the tool wheel from a thinner material.

In another embodiment of the invention, the end of a chip outlet has a partially cylindrical shape. By virtue of this arrangement, the end of a chip outlet can be provided with a protective sleeve, comprising a corresponding partially cylindrical element. Preferably the shape of the protective sleeve fits closely against the partially cylindrical shape of the chip outlet.

DESCRIPTION OF THE DRAWINGS

Other objects and advantages of the invention will become evident to one of ordinary skill in the art from the following detailed description made with reference to the accompanying drawings in which.

DESCRIPTION OF THE PREFERRED EMBODIMENTS

Figure 1:
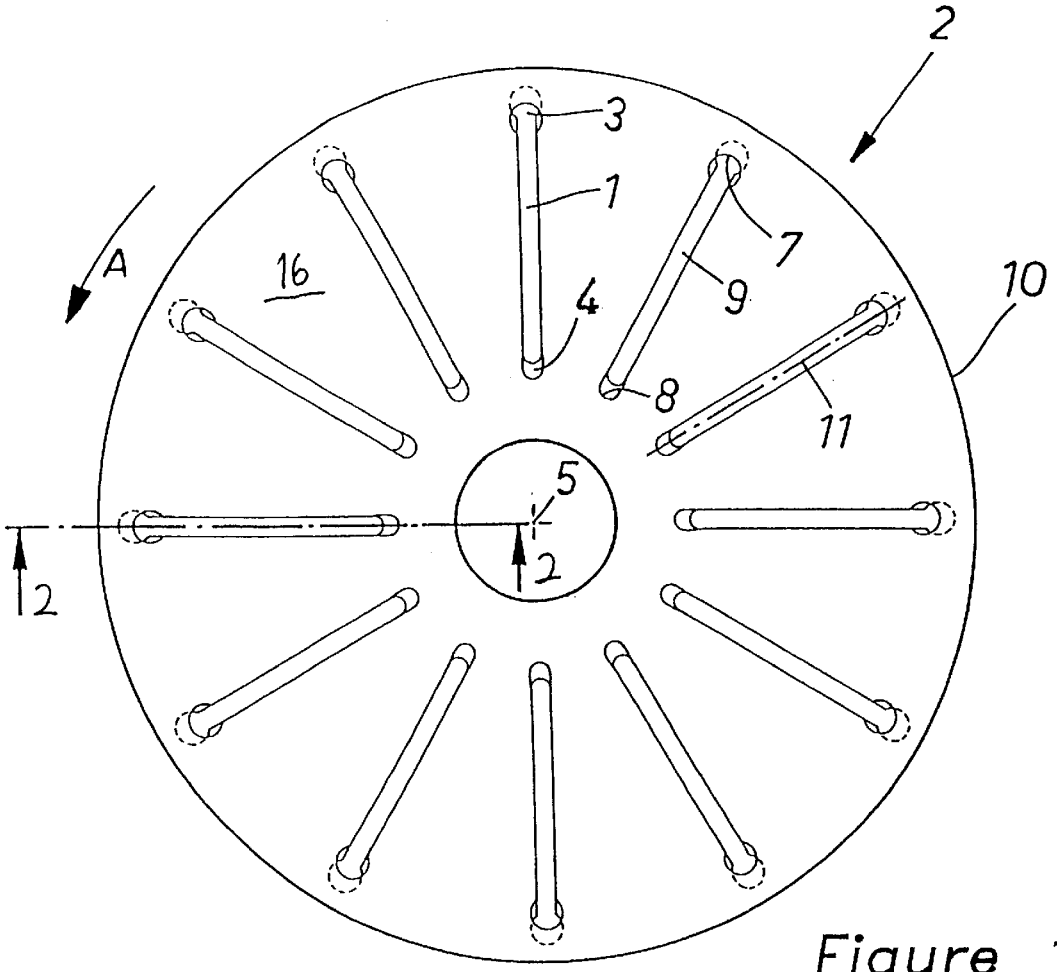
FIG. 1 shows a schematic plan view, partly in phantom, of the working face of a disk chipper tool wheel provided with the chip outlets of the invention.
Figure 2:
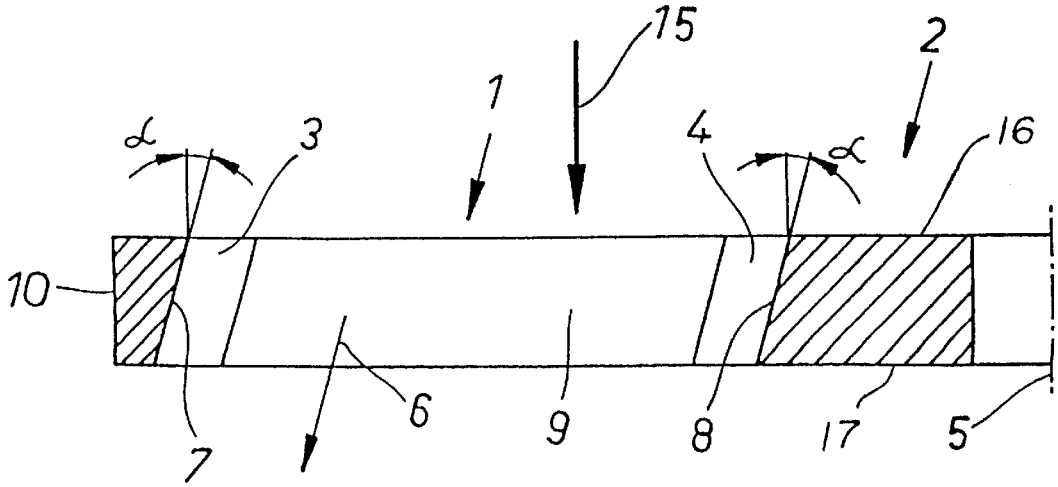
FIG. 2 shows a cross-section along the line 2—2 in FIG. 1.
Figure 5:
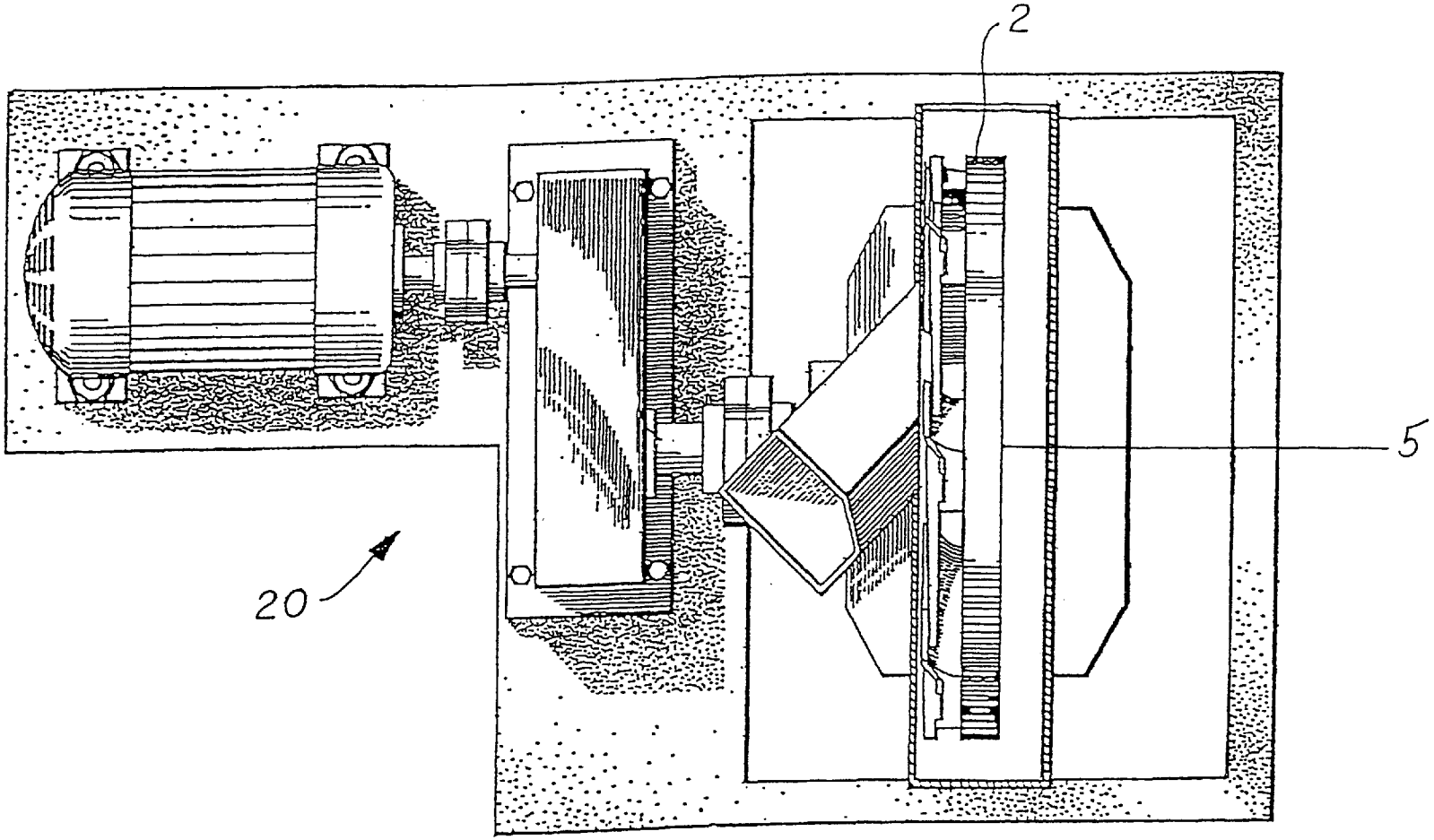
Figure 5 (Prior Art)
FIG. 5 is a schematic top view of a typical disc chipper.

FIG. 5 illustrates a typical disc chipper 20. The tool wheel, generally 2, is rotatably mounted about an axis 5 within the disc chipper 20. With reference to FIGS. 1 and 2 the tool wheel may be disc shaped, with a working face 16 and an opposing chip discharge face 17. The working face is shown in FIG. 1. The tool wheel includes a plurality of chip outlets 1. Each chip outlet comprises on an elongated aperture extending between the working face and the discharge face. Each chip outlet includes a radially inner end 4 and a radially outer end 3. Connected by a straight section 9. A chipper tool (not shown) is mounted to the working face 16 adjacent each chip outlet 1.

As shown in FIGS. 1 and 2, at least one end 3 or 4 of the chip outlet 1 is beveled or inclined at an angle relative to the axis of rotation. the bevel is integral with the material of the tool wheel. Preferably, the angle of inclination is such that the bevel extends radially outward from the working face to the discharge face. FIG. 2 also shows the chip flow 6 and wood traveling 15 directions. The chip flow direction 6 is likewise directed outwards from the center axis 5 of the tool wheel 2.

As shown in FIG. 2, each beveled end of the chip outlet 1 has an inclination angle  relative to the center axis 5 of the tool wheel 2. Preferably, the inclination angle is at least 10 degrees. By virtue of this bevel or angle incorporated into the end of the chip outlet, the tension peak shifts from the tool wheel side face surface to its center. This reduces the tension level in the tool wheel and consequently increases its fatigue strength. In another variation the inclination angle of each end 3 and 4 is substantially equal.

The tool wheel 2 is preferably manufactured from a blank sheet or form. The chip outlets 1 are initially formed by flame cutting followed by finish machining of the chip outlet sides and ends.

Figure 3:
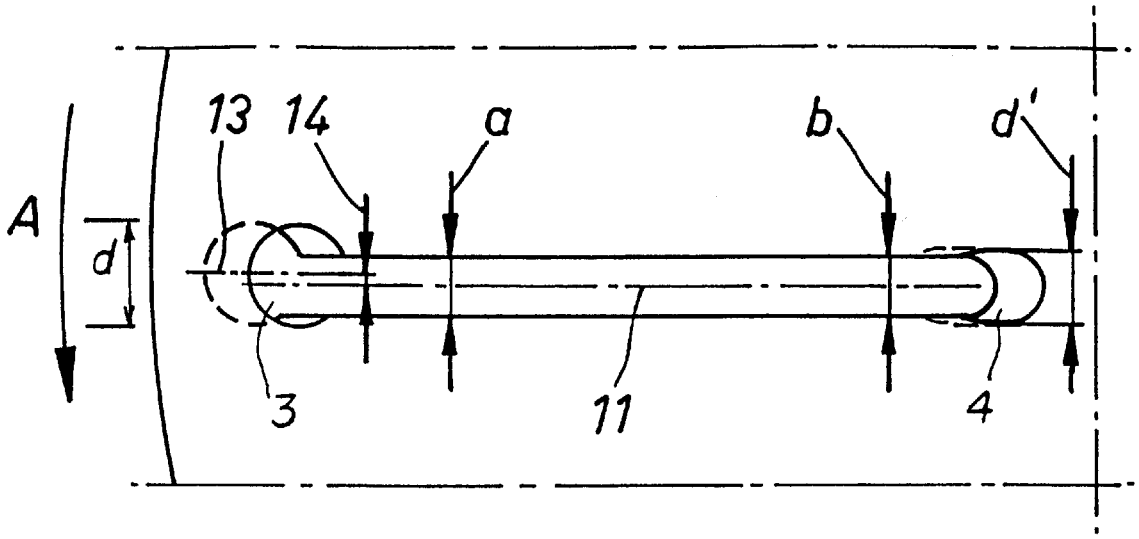
FIG. 3 shows a single chip outlet of FIG. 1, partly in phantom, in a larger scale.
Figure 4:
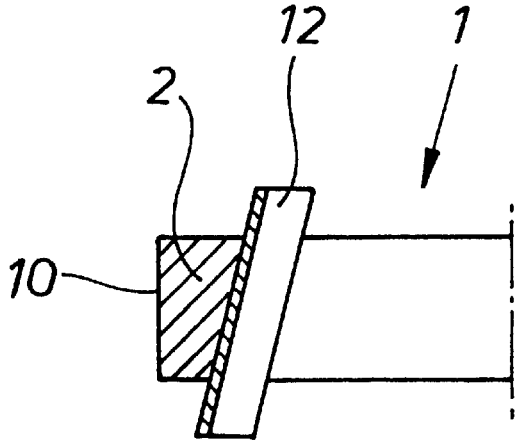
FIG. 4 is a partial, cross-sectional view along the line 2—2 of FIG. 1 showing the end of a chip outlet of the invention fitted with a protective sleeve.

In another embodiment shown in FIGS. 1 and 3, at least one beveled end 3, 4 of the chip outlet 1 has a partially cylindrical shape 7, 8 respectively. The shape is integral with the material of the tool wheel 2. By virtue of this shape, either end 3, 4 of the chip outlet can be provided with a mating trough-like protective sleeve 12 as shown in FIG. 4. The sleeve has a partially cylindrical shape which corresponds to and mounts against its corresponding beveled end. The sleeve may be manufactured, for example, from a length of pipe which is machined longitudinally.

In a further embodiment shown in FIG. 3, each end 3, 4 of the chip outlet 1 has a transverse width d, d' respectively. In order to mitigate blocking of the chip outlet, at least one end is arranged such that the transverse width of the end d, d' is greater than the transverse width of the chip outlet adjacent to that end a, b respectively.

In another variation, the transverse width of the chip outlet becomes greater radially outward from the axis of rotation. That is, transverse width a is greater than transverse width b.

In a still further embodiment also shown in FIG. 3, the chip outlet defines an longitudinal centerline 11. End 3 defines a different center line 13, which is offset from the chip outlet centerline by a distance 14. Preferably the offset is arranged such that as the tool wheel rotates in direction A, the chip outlet centerline 11 precedes the end centerline 13.

While various embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed:

1. A tool wheel rotatably mounted in a disk chipper, including:

an axis of rotation;

a working face and an opposing discharge face; and a chip outlet comprising an elongated aperture defined through said faces, said chip outlet having spaced ends connected by a straight section, said ends being integrally formed in said tool wheel, wherein at least one said end is beveled relative to the axis.

2. A tool wheel as in claim 1 further including a wood traveling direction, wherein at least one said end of the chip outlet is beveled outwards relative to a center axis of the tool wheel in the wood traveling direction.

3. A tool wheel as in claim 1 wherein a said end of the chip outlet is beveled outwards relative to a center axis of the tool wheel from the working face to the discharge face.

4. A tool wheel as in claim 3, wherein a said end of the chip outlet has an angle of inclination of at least 10 degrees relative to the center axis of the tool wheel.

5. A tool wheel as in claim 3, wherein each end of the chip outlet has an angle of inclination, and both said angles are essentially equal.

6. A tool wheel as in claim 1, wherein:

an end of the chip outlet defines a first transverse width;

the straight section adjacent said end defines a second transverse width; and said first transverse width is greater than said second transverse width.

7. A tool wheel as in claim 1, wherein at least one end of the chip outlet is partially cylindrically shaped.

8. A tool wheel as in claim 7, further comprising a protective sleeve mounted to said partially cylindrical end.

9. A tool wheel as in claim 1, wherein said strait section defines a first transverse width adjacent the axis of rotation and a second transverse width radially outward from said first transverse width, said second transverse width being greater than said first transverse width.

10. A tool wheel as in claim 1, wherein:

said strait section defines a first centerline; and a said end of the chip outlet defines a second centerline offset from said first centerline.

11. A tool wheel as in claim 10, wherein said first centerline precedes said second centerline when said tool wheel is rotated.

* * * * *